US007762544B2

(12) United States Patent
Mitsuya et al.

(10) Patent No.: US 7,762,544 B2
(45) Date of Patent: Jul. 27, 2010

(54) PAPER SHEET FEEDING DEVICE

(75) Inventors: Yusuke Mitsuya, Yokohama (JP); Yoshihiko Naruoka, Yokohama (JP); Naruaki Hiramitsu, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/388,675

(22) Filed: Feb. 19, 2009

(65) Prior Publication Data

US 2010/0001456 A1 Jan. 7, 2010

(30) Foreign Application Priority Data

Jul. 4, 2008 (JP) ..... 2008-175684

(51) Int. Cl.
*B65H 3/14* (2006.01)

(52) U.S. Cl. ..... 271/98; 271/106

(58) Field of Classification Search ..... 271/149, 271/150, 106, 97, 98
See application file for complete search history.

(56) References Cited

U.S. PATENT DOCUMENTS 6,702,275 B2 * 3/2004 Niiyama et al. ..... 271/98

FOREIGN PATENT DOCUMENTS

JP 2007-326713 12/2007

* cited by examiner

*Primary Examiner*—Kaitlin S Joerger
(74) *Attorney, Agent, or Firm*—Pillsbury Winthrop Shaw Pittman, LLP

(57) ABSTRACT

A paper sheet feeding device for sequentially feeding, to a conveyance path, mail items simultaneously received includes a suction mechanism provided adjacent to a pickup position. The suction mechanism includes a chamber having an opening opposed to the pickup position, a guide plate provided at the opening of the chamber, and two projections vertically arranged on the surface of the guide plate. When air is drawn from the pickup position through a plurality of suction holes formed in the guide plate, the leading one of the mail items closest to the pickup position is drawn to the pickup position, and is curved between the two projections. A handling nozzle blows air into the space that is formed between the leading mail item and a subsequent mail item when the leading mail item is curved.

8 Claims, 8 Drawing Sheets

PAPER SHEET FEEDING DEVICE

CROSS-REFERENCE TO RELATED APPLICATIONS

This application is based upon and claims the benefit of priority from prior Japanese Patent Application No. 2008-175684, filed Jul. 4, 2008, the entire contents of which are incorporated herein by reference.

BACKGROUND OF THE INVENTION

1. Field of the Invention

The present invention relates to a paper sheet feeding device for feeding a plurality of accumulated paper sheets one by one.

2. Description of the Related Art

A paper sheet feeding device is known by, for example, Jpn. Pat. Appln. KOKAI Publication No. 2007-326713. The paper sheet feeding device disclosed in this publication is incorporated in a mail processing apparatus for reading the addresses of mail items to sort them, and is designed to feed the mail items to a conveyance path one by one.

To this end, the feeding device comprises a receiving section (hopper) for simultaneously receiving a plurality of mail items upright; a supply mechanism for forwardly moving the received mail items and supplying them one after another toward a pickup position; a pickup belt designed to run along the pickup position for picking up each mail item by a suction force and transferring it to the conveyance path; a conveyance mechanism for pulling, using a nip, each mail item picked from the pickup position by the pickup belt and transferring it, at a speed slightly higher than the pickup speed; and a separation mechanism for separating mail items from the earliest picked one of the mail items when these mail items are picked up unintentionally simultaneously.

The feeding device also comprises a suction mechanism for applying air of negative pressure to the mail item (to be picked up earliest) positioned at the pickup position, thereby quickly positioning the same at the pickup position. The suction mechanism is located upstream of the pickup belt with respect to the pickup direction of mail items. By thus locating the suction mechanism adjacent to the pickup belt, a mail item to be subsequently picked up can be quickly positioned at the pickup position, whereby the pickup speed of mail items can be enhanced.

However, when mail items, such as relatively thin and short post cards, are fed by the above-described feeding device, so-called "simultaneous pickup," in which a leading mail item and a subsequent one are simultaneously picked up, may well occur. Namely, immediately after a mail item, which is relatively short in the pickup direction, is moved to the pickup position by the suction force of the suction mechanism and then picked up therefrom by the pickup belt also using a suction force, the rear end of the mail item with respect to the pickup direction falls out of the range of the suction mechanism, and air of negative pressure is applied to the subsequent mail item by the suction mechanism.

At this moment, the rear end of the first-fed mail item is pressed against the pickup belt by the subsequent mail item, whereby these mail items tightly contact each other, the conveyance force of the pickup belt is also exerted on the subsequent mail item. This being so, such relatively thin and short mail items may easily be picked up simultaneously.

BRIEF SUMMARY OF THE INVENTION

It is an object of the invention to provide a paper sheet feeding device in which the possibility of occurrence of the above-mentioned "simultaneous pickup" of two or more paper sheets is suppressed.

To attain the object, a paper sheet feeding device comprising: a supply mechanism configured to move a plurality of paper sheets simultaneously received upright and to feed a leading one of the paper sheets toward a pickup position; a pickup mechanism configured to be brought into contact with the leading paper sheet fed toward the pickup position, and then to rotate to thereby pick up the leading paper sheet in a direction parallel to a surface of the leading paper sheet; a suction mechanism configured to produce a flow of air upstream of a position, at which the pickup mechanism is brought into contact with the leading paper sheet, with respect to a direction in which the leading paper sheet is picked up, the flow of air being used to draw the leading paper sheet to the pickup position; curving means configured to cooperate with the suction mechanism to curve the leading paper sheet drawn to the pickup position; and handling means configured to supply air into a gap formed between the leading paper sheet and a subsequent paper sheet superposed on the leading paper sheet, by curving the leading paper sheet using the curving means, thereby separating the leasing paper sheet from the subsequent paper sheet.

In the above invention, a paper sheet drawn to the pickup position is curved to form a gap between the paper sheet and a subsequent paper sheet, and air is blown into the gap to separate the paper sheets from each other. As a result, so-called "simultaneous pickup," in which one or more paper sheets superposed on a leading paper sheet to be picked up from the pickup position are picked up unintentionally simultaneously with the leading paper sheet, can be kept at a low rate of occurrence.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the invention will be described in detail with reference to the accompanying drawings.

Figure 1:
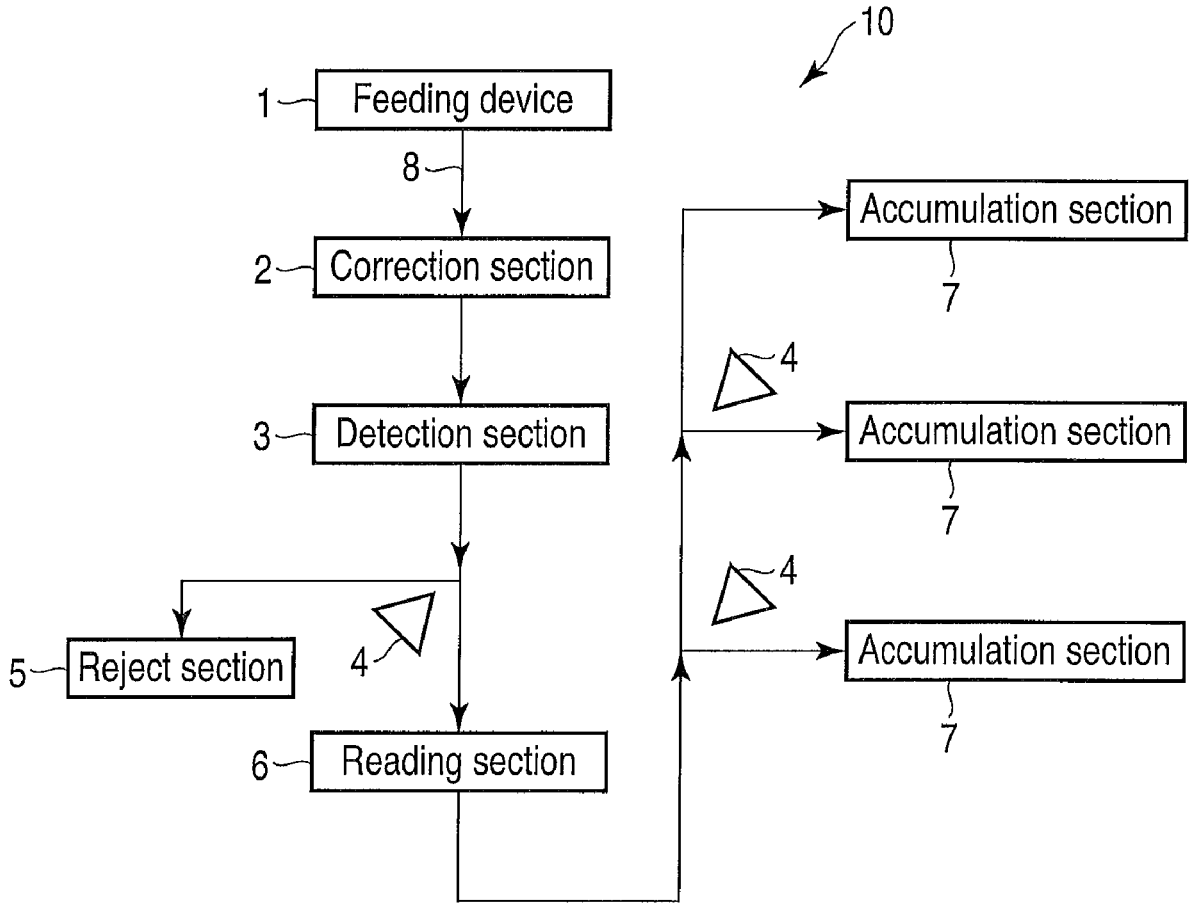
FIG. 1 is a block diagram illustrating the configuration of a sorting apparatus that incorporates a mail feeding device according to embodiments of the invention.

FIG. 1 is a block diagram illustrating the configuration of a sorting apparatus 10 that incorporates a mail feeding device 1 (a paper sheet feeding device) (hereinafter, "the feeding device 1") according to embodiments of the invention. The sorting apparatus 10 sequentially reads the addresses of a plurality of mail items (paper sheet) and sorts the items in accordance with the read addresses, and incorporates a correction section 2, a detection section 3, a sorting section 4, a reject section 5, a reading section 6 and accumulation sections 7.

Mail items are accumulated and set in the feeding device 1, and are fed one by one to a conveyance path 9 by operating the feeding device 1 as described later. The conveyance path 9 is defined by pairs of endless conveyance belts (not shown). Mail items are conveyed, held by the conveyance belts.

Each mail item transferred to the conveyance path 9 is corrected in attitude by the correction section 2, and conveyed to the detection section 3, where it is detected, for example, whether simultaneous pickup of two or more mail items is made, whether the space (gap) between adjacent mail items is small, and how each mail item is tall and thick. The mail items detected as irregular are conveyed to the reject section 5 via the sorting section 4. The other mail items are conveyed to the downstream-side reading section 6 via the sorting section 4.

The reading section 6 reads information, such as an address, from each mail item. Based on various information items read by the reading section 6, a controller, not shown, determines the destination of each mail item. Mail items having passed the reading section 6 are sorted into corresponding accumulation sections 7 via the sorting section 4.

Figure 2:
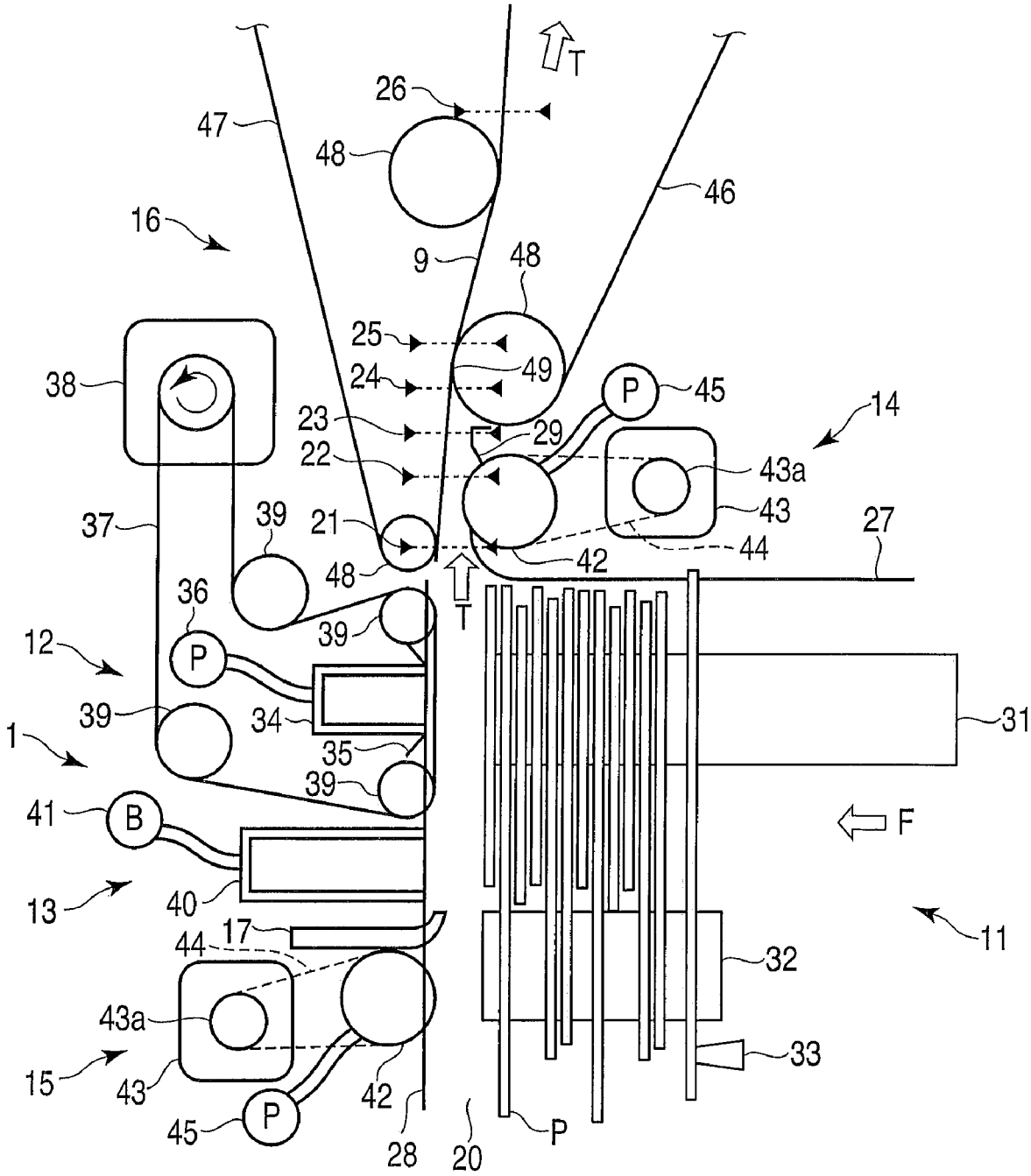
FIG. 2 is a schematic view illustrating a mail feeding device according to a first embodiment and incorporated in the sorting apparatus of FIG. 1.

FIG. 2 is a schematic view illustrating a feeding device 1 according to a first embodiment of the invention. The feeding device 1 comprises a supply mechanism 11, a pickup mechanism 12, a suction mechanism 13, a separation mechanism 14, an assisting mechanism 15, and a conveyance mechanism 16. The feeding device 1 further comprises a handling nozzle 17, described later in detail, provided between the suction mechanism 13 and the assisting mechanism 15.

The supply mechanism 11 moves accumulated mail items P toward a pickup position 20 in the direction indicated by arrow F, and positions the leading mail item P at the pickup position 20. The pickup mechanism 12 picks up the mail item P positioned at the pickup position 20, moves the same in a direction parallel to its surface, and transfers the same to the conveyance path 9. The suction mechanism 13 produces the flow of air used to draw air so as to move the leading mail item P to the pickup position 20. The suction mechanism 13 is provided adjacent to the pickup mechanism 12 and upstream thereof with respect to a mail pickup direction T.

The separation mechanism 14 separates, from the mail item P picked up from the pickup position 20, one or more subsequent mail items P picked up unintentionally simultaneously with the first-mentioned one. The assisting mechanism 15 located upstream of the pickup mechanism 12 applies, while rotating, negative pressure to the mail item P positioned at the pickup position 20, thereby accelerating the pickup of the mail item P. The conveyance mechanism 16 pulls the mail item P having passed the separation mechanism 14, and conveys the same further downward.

The feeding device 1 also comprises six sensors 21, 22, 23, 24, 25 and 26 for detecting passing of the mail item P transferred from the pickup position 20 to the conveyance path 9. The sensors 21 to 26 each include an emission section and a light receiving section, which oppose each other with the conveyance path 9 interposed therebetween, and detect passing of the mail item P when their optical axes are crossed by the mail item.

The feeding device 1 yet further comprises a plurality of conveyance guides 27, 28 and 29. The conveyance guide 27 extends in parallel to floor belts (described later), and is used to align the front ends of mail items P accumulated upright with respect to the pickup direction T. FIG. 2 shows a state in which the front ends of the mail items P are not aligned with each other. Actually, however, when an operator puts mail items P into the receiving section (hopper), they align the front ends of the items P along the conveyance guide 27. The conveyance guide 28 extends along the pickup position 20 and defines one side of the pickup position 20. The front surface of each mail item P is brought into contact with the conveyance guide 28.

More specifically, the supply mechanism 11 comprises two floor belts 31 and 32 to be brought into contact with the lower ends of mail items P to move the mail items P in the direction F. Thus, the mail items P are received upright on the floor belts 31 and 32. A backup plate 33 is provided at a position at which it is brought into contact with the surface of the rearmost one of the accumulated mail items P to supply the same to the pickup position 20 along with the floor belt 31. To this end, the backup plate 33 is connected to the floor belt 31 in a simple way, and is moved in the direction F when the floor belt 31 is driven.

The pickup mechanism 12 comprises a chamber 34, a guide 35 and a vacuum pump 36 (or an equivalent member). An electromagnetic valve, not shown, used to execute on/off control of negative pressure is provided across a pipe that connects the chamber 34 to the vacuum pump 36. The pickup mechanism 12 also comprises an endless pickup belt 37 that includes a part running along the pickup position 20 in the direction T to pick up each mail item P, and a motor 38 for driving the pickup belt 37.

The pickup belt 37 has a large number of suction holes (not shown), and is stretched between a plurality of rollers 39 so that at least part of the pickup belt 37 runs along the pickup position 20 in the direction T. The guide 35 is provided within the pickup belt 37, opposing the pickup position 20 with the belt 37 interposed therebetween. The chamber 34 has an opening opposing the reverse side of the guide 35, i.e., opposing the pickup position 20 with the pickup belt 37 and the guide 35 interposed therebetween.

The suction mechanism 13 comprises a chamber 40 that is provided between the pickup mechanism 12 and the assisting mechanism 15, and has an opening opposing the reverse side of the conveyance guide 38, i.e., opposing the pickup position 20 with the pickup belt 37 and the guide 38 interposed therebetween. The suction mechanism 13 also comprises a blower 41 (or an equivalent member) for drawing air from the chamber 40. The guide 28 includes a portion that has the same width as the opening of the chamber 40, and a plurality of suction holes (described later) formed therein.

The separation mechanism 14 substantially opposes the pickup mechanism 12 with the conveyance path 9 interposed therebetween, the conveyance path 9 being located downstream of the pickup position 20 (in the upper position in FIG. 2) with respect to the mail pickup direction T. The separation mechanism 14 applies negative pressure to each mail item P conveyed on the conveyance path 9 from the opposite side of the pickup mechanism 12, and imparts thereto a separation force that exerts in the opposite direction to the direction T. Namely, even when one or more subsequent mail items P are picked up unintentionally simultaneously with a leading mail item P picked up from the pickup position 20, the above-mentioned negative force and separation force cause the subsequent mail items P to stop or return and be separated from the leading mail item P.

More specifically, the separation mechanism 14 comprises a substantially cylindrical separation roller 42 that is provided along the conveyance path 9 and rotatable in opposite directions. The separation roller 42 is rotatably supported via a bearing (not shown) by an axis of rotation (not shown) fixed on the conveyance path 9. Further, the separation roller 42 has a large number of suction holes formed therethrough to make the inner and outer peripheral surfaces communicate with each other.

The separation mechanism 14 further comprises a motor 43 for rotating the separation roller 42 in the opposite directions, and an endless timing belt 44 for transmitting the driving force of the motor 43 to the separation roller 42. The timing belt 44 is stretched between a timing pulley 43*a* secured to the rotation axis of the motor 43, and the separation roller 42. The separation mechanism 14 also comprises a vacuum pump 45 (or an equivalent member) for applying negative pressure to the outer peripheral of the separation roller 42 via the suction holes.

The assisting mechanism 15 is located upstream of the suction mechanism 13 (below the suction mechanism 13 in FIG. 2) with respect to the pickup direction of mail items P. Since the assisting mechanism 15 has substantially the same structure as the above-described separation mechanism 14, it is not described in detail.

The conveyance mechanism 16 comprises two conveyance belts 46 and 47 located to define the conveyance path 9 downstream of the pickup position 20. Each of the conveyance belts 46 and 47 is stretched between a plurality of rollers 48. The frond end of each mail item P conveyed on the conveyance path 9 in the direction T is nipped by a nip 49 formed of superposed portions of the conveyance belts 46 and 47, and then further conveyed downward in accordance with the running of these belts.

In the above-described feeding device 1, accumulated mail items P are moved in the direction F by the supply mechanism 11, and the leading mail item P is drawn to the pickup position 20 by the suction mechanism 13. Thus, the suction mechanism 13 located at the pickup position 20 enables the leading one of the mail items P supplied by the supply mechanism 11 to be quickly shifted to the pickup position 20.

The mail item P drawn to the pickup position 20 is held on the surface of the pickup belt 37 of the pickup mechanism 12 by a suction force, and is forwarded in the pickup direction T along with the pickup belt 37. When the front end of the mail item P reaches the conveyance mechanism 16, it is pulled and further conveyed downward on the conveyance path 9 by the mechanism 16, while it is detected by the six sensors 21 to 26.

At this time, since negative pressure is applied to the outer periphery of the separation roller 42 of the separation mechanism 14, and the separation roller 42 is rotated in the direction opposite to the mail pickup direction T, one or more subsequent mail items P picked up from the pickup position 20 unintentionally simultaneously with a leading mail item P can be separated from the latter. Also, at this time, negative pressure is produced upstream of the pickup position 20 through the assisting roller 42 of the assisting mechanism 15, thereby assisting the pickup operation of the pickup mechanism 12.

Mail items P fed to the feeding device 1 via the supply mechanism 11 are different in thickness, weight, lengths, width and the like. Accordingly, when the front ends of the mail items are aligned with each other along the conveyance guide 27, their rear ends are inevitably misaligned as shown in FIG. 2. As a result, so-called "simultaneous pickup," in which one or more subsequent mail items are picked up unintentionally simultaneously with a leading mail item P when the leading mail item is picked up, may well occur if the leading mail item P is, for example, a relatively small and thin post card.

More specifically, immediately after the pickup mechanism 12 picks up a relatively small and thin mail item P that was moved to the pickup position 20 by applying thereto negative pressure through the suction mechanism 13, the pickup-directional rear end of the mail item P is displaced from the position opposing the chamber 40 of the suction mechanism 13. At this time, negative pressure is applied to a subsequent mail item P through the suction mechanism 13 immediately after the rear end of the first-mentioned mail item P (i.e., the leading mail item P) passes the suction mechanism 13, whereby the subsequent mail item P is instantly drawn to the pickup position 20, and the rear end of the leading mail item P is held between the subsequent mail item P and the conveyance guide 28 if the leading mail item P is thin. In this state, the subsequent mail item P is in tight contact with the rear end of the leading mail item P by the pressure of contact, and hence is picked up by the pickup mechanism 12 simultaneously with the leading mail item P. Since this state occurs immediately after pickup of the leading mail item P is started, there is almost no difference in conveyance speed between the leading and subsequent mail items P. Therefore, the subsequent mail item P is more easily picked up simultaneously with the leading mail item.

As described above, when simultaneous pickup of two or more mail items P occurs, to-be-separated mail item(s) P is separated by the separation mechanism 14 located downstream of the pickup position 20. Ideally, however, factors for causing simultaneous pickup when mail items are picked up from the pickup position 20 should be eliminated as far as possible.

To this end, the embodiment is constructed such that the leading mail item P drawn to the pickup position 20 is curved using the suction operation of the above-described suction mechanism 13, thereby forming a space between the leading mail item P and a subsequent mail item P, and that air is introduced into the space to separate the mail items P from each other.

Figure 3:
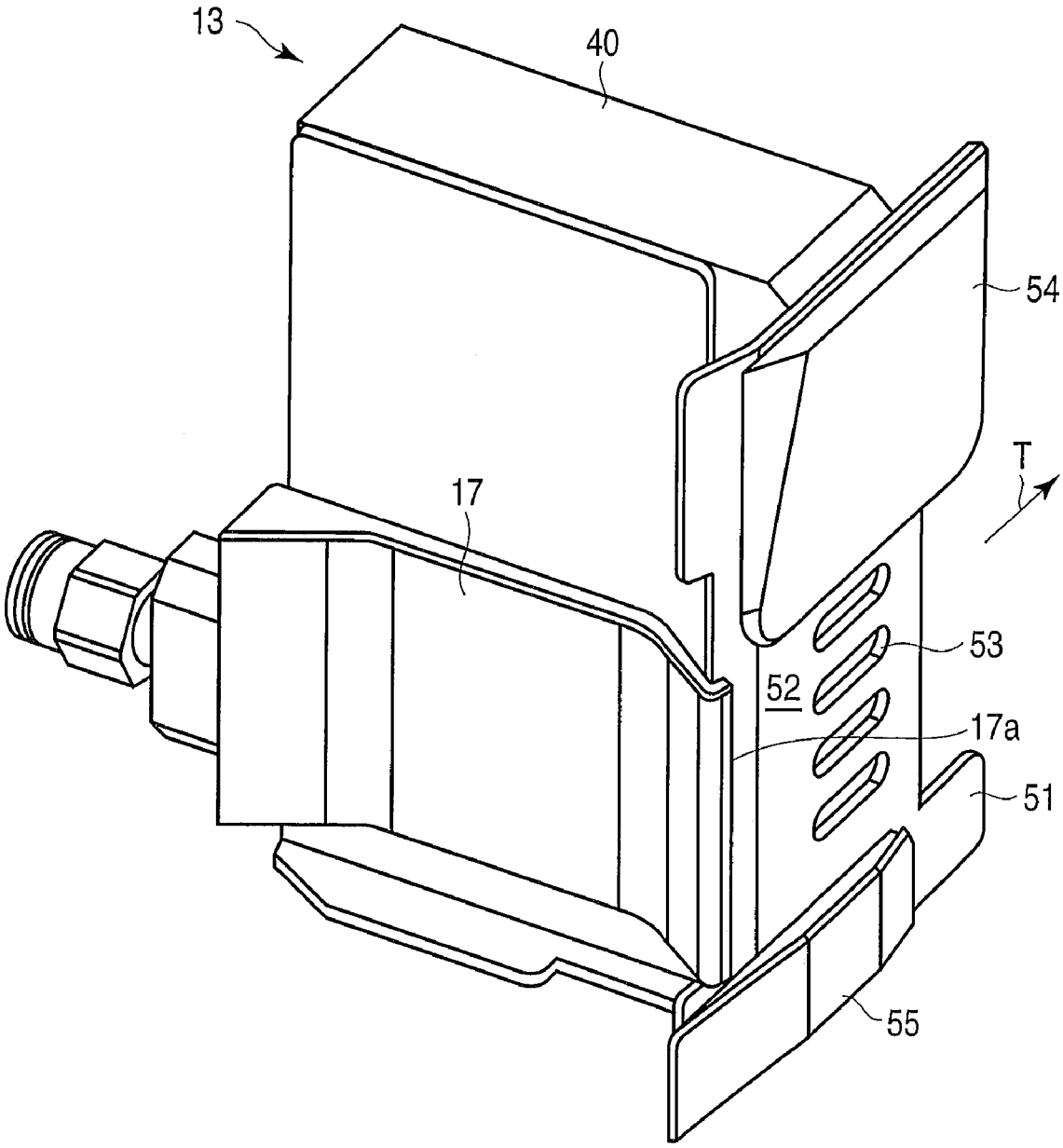
FIG. 3 is a schematic perspective view illustrating a suction mechanism and a handling nozzle incorporated in the feeding device of FIG. 2.
Figure 4:
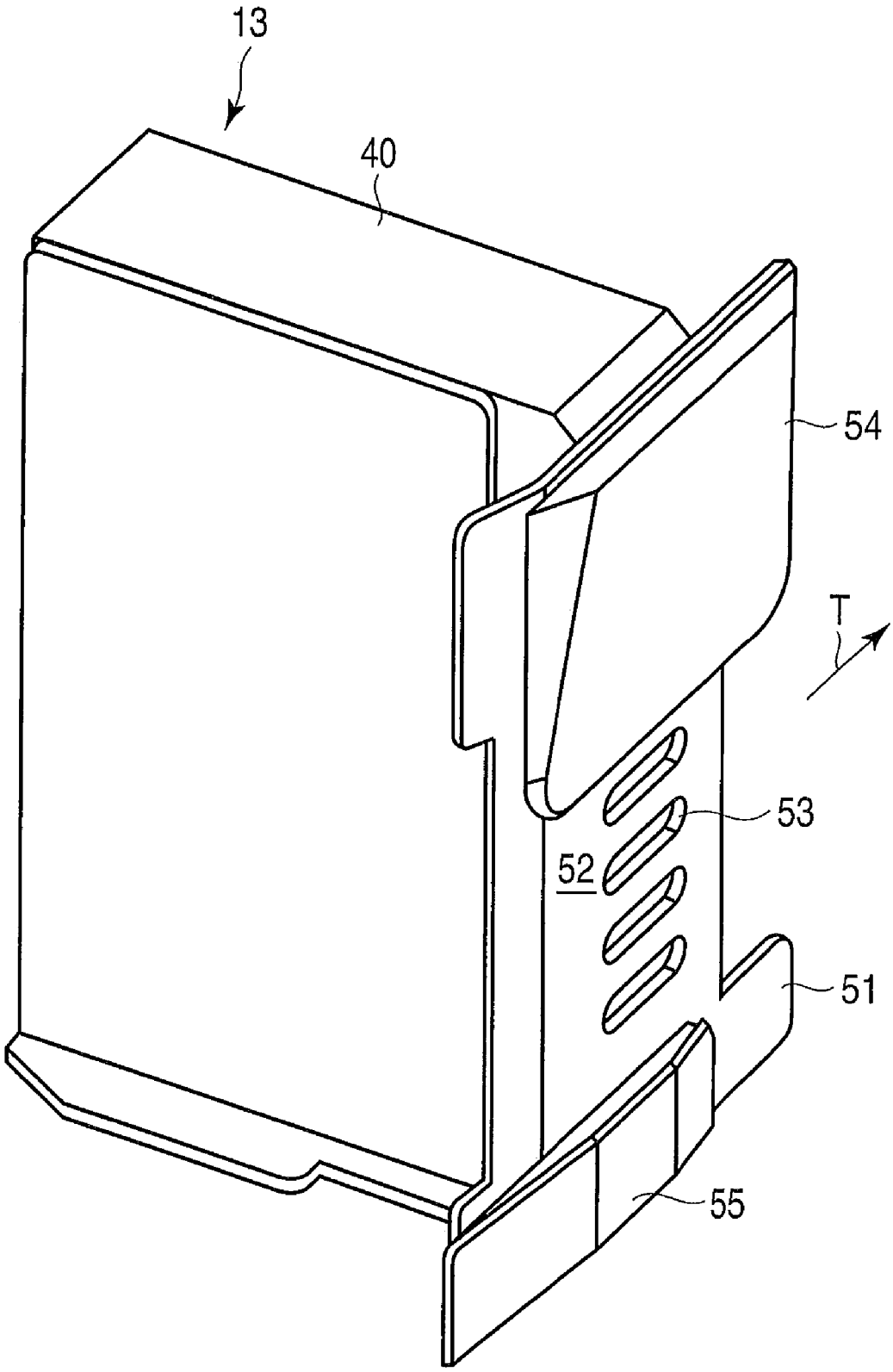
FIG. 4 is a schematic perspective view illustrating a state in which the handling nozzle is removed from the structure of FIG. 3.
Figure 5:
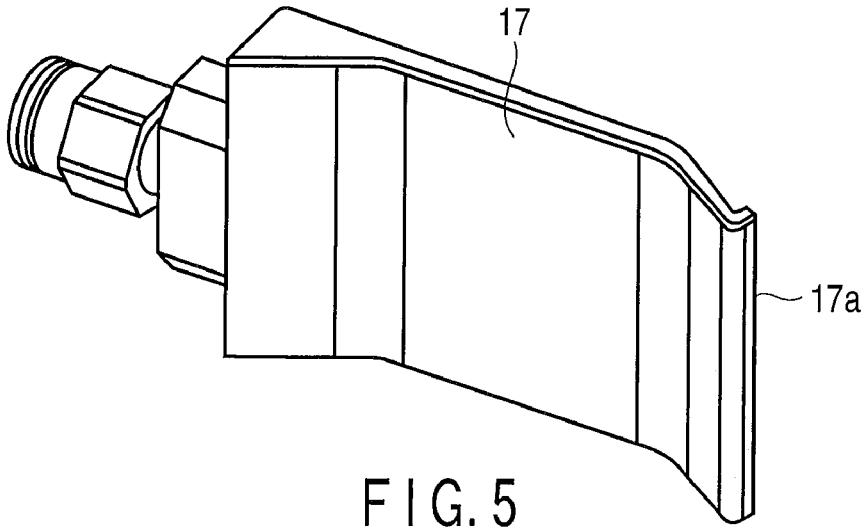
FIG. 5 is a schematic perspective view illustrating the handling nozzle of FIG. 2.

Referring now to FIGS. 3 to 5, a description will be given of curving means for curving a leading mail item P, and handling means for separating a subsequent mail item from the leading mail item. FIG. 3 is a perspective view illustrating the essential part of the above-described suction mechanism 13, and the schematic structures of the curving means and the handling means. FIG. 4 is a perspective view illustrating the structure obtained by eliminating the handling means from the structure shown in FIG. 3. FIG. 5 is a perspective view of the handling means. Although a description will be given of the case where a leading mail item P positioned at the pickup position 20 and a subsequent mail item P are handled by imparting a gap therebetween, three or more mail items superposed on each other can also simultaneously be handled using the means described below.

As shown in FIG. 4, the opening of the chamber 40 of the suction mechanism 13 opposing the pickup position 20 is blocked by a guide plate 51. The guide plate 51 forms part of the above-described conveyance guide 28, and includes a surface 52 opposing the pickup position 20. The guide plate 51 has a plurality of horizontally elongated suction holes 53 formed therein.

In this structure, when air is drawn from the chamber 40 using the blower 41, negative pressure occurs at the opening of the chamber 40 to draw air near the pickup position 20 through the suction holes 53 of the guide plate 51. The suction force of the blower 41 is set smaller than that of the pump 36 of the pickup mechanism 12, and the size of each suction hole 53 is set to compensate for the effect of the relatively small suction force of the blower 41. As a result, relatively strong negative pressure is applied to the mail item P closest to the pickup position 20 to draw the same to the pickup position 20.

As described above, the suction mechanism 13 is designed to introduce air into a gap defined between a relatively thin and small leading mail item P, curved by the curving means, and a subsequent mail item P. For this purpose, the suction mechanism 13 functions to cooperate with the curving means, described later, to curve the thin and small mail item P. This being so, it is necessary to locate the suction mechanism 13 at a position at which it can draw the rear end (with respect to the pickup direction T) of a mail item Pmin that is shortest along the conveyance guide 28 among the mail items P processed by the feeding device 1.

The surface 52 of the guide plate 51 has upper and lower projections 54 and 55 (first and second projections) vertically separated with the suction holes 53 interposed therebetween. The projections 54 and 55 are used to prevent a mail item P from being brought into contact with the surface 52, and to curve the same therebetween, after the mail item P, positioned at the pickup position 20, is drawn toward the surface 52 by negative pressure applied to them through the suction holes 53. Namely, the two projections 54 and 55 serve as the curving means of the present invention that cooperates with the suction mechanism 13 to curve each mail item P.

Since the two projections 54 and 55 are provided to curve a mail item P after it is drawn by the suction mechanism 13, they can be modified freely in shape, size, etc. However, if the degree of projection is too high, the resultant curvature becomes excessive, which may well be an obstacle in the pickup operation of the pickup mechanism 12 located downstream of the suction mechanism 13. Therefore, it is desirable to set the degree of projection to a value that enables a leading mail item P to be curved so as to define a slight gap between the same and a subsequent one.

Further, it is sufficient if at least one of the two projections 54 and 55 is provided on the surface 52 of the guide plate 51, since provision of these projections is aimed to curve mail items P. In the feeding device 1 of the first embodiment, mail items P are fed to the pickup position 20 using the two floor belts 31 and 32 and the backup plate 33, and hence the lower ends of the mail items P are kept in contact with the floor belts 31 and 32. Accordingly, when the suction mechanism 13 draws a mail item P to the pickup position 20, the lower end of the mail item P is kept on the floor belts 31 and 32 by their frictional forces for a short time, and reaches the pickup position 20 slightly later than the upper end of the mail item P. In this structure, only the lower projection 55 may be used. However, when employing only one projection, it is desirable to employ the upper projection 54.

As shown in FIGS. 2 and 3, the handling nozzle 17 is provided upstream of the suction mechanism 13, and a blower (not shown) is connected to the proximal end of the handling nozzle 17. More specifically, as shown in FIG. 3, the handling nozzle 17 is provided in contact with the upstream side of the chamber 40 of the suction mechanism 13. The handling nozzle 17 is formed substantially rectangular, contains an air passage therein, and has a vertically extending slim discharge port 17*a*, which will now be described.

As also illustrated in FIG. 5, the distal end of the handling nozzle 17, at which the discharge port 17*a* is formed, is angled at substantially right angles. This structure can effectively discharge air to the gap formed between a leading mail item P curved by the projections 54 and 55, and a subsequent mail item P, but the distal end of the nozzle 17 inevitably projects toward the pickup position 20 as shown in FIG. 2. In the first embodiment, the degree of projection of the handling nozzle 17 is minimized to gently curve the outer surface of the angled end of the nozzle so as not to catch the front end of each mail item P.

By providing the handling nozzle 17 of the above configuration at the above-mentioned position, air can effectively be discharged into the gap formed between the rear end of a leading mail item P, which is relatively thin and small, and the front end of a subsequent mail item P, with the leading mail item P curved. As a result, successively fed mail items P can be handled. Thus, the handling nozzle 17 serves as handling means of the invention.

Figure 6:
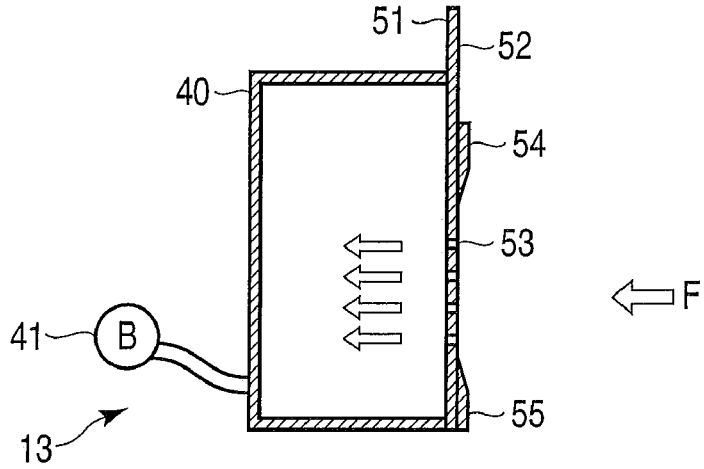
FIG. 6 is a schematic sectional view of the suction mechanism of the feeding device of FIG. 2, obtained when viewed in the pickup direction of mail items.
Figure 7:
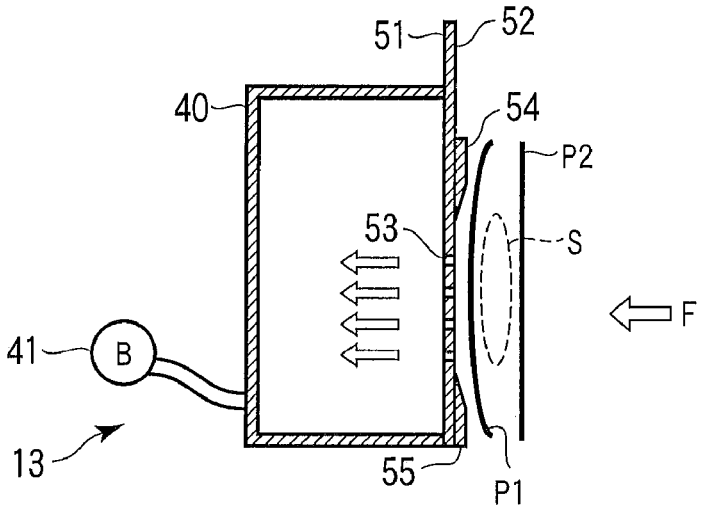
FIG. 7 is a schematic sectional view illustrating a state in which a leading mail item is drawn to a pickup position by the suction mechanism shown in FIG. 6.
Figure 8:
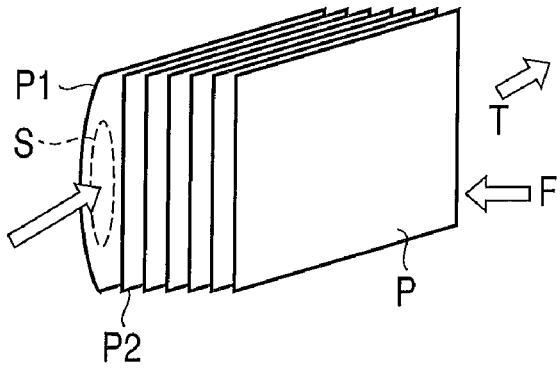
FIG. 8 is a schematic perspective view illustrating a state in which only a leading mail item, i.e., a mail item at a pickup position, is curved.
Figure 9:
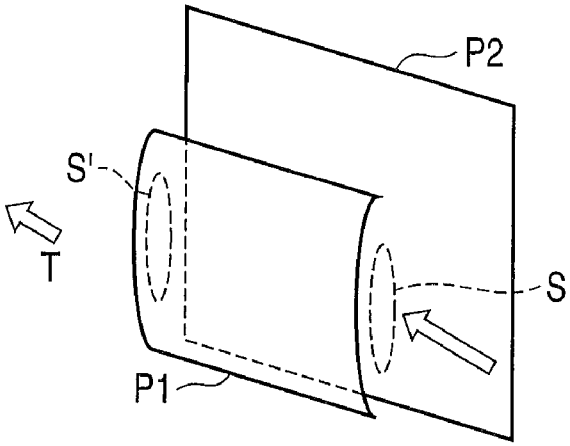
FIG. 9 is a schematic perspective view useful in explaining the positional relationship between the curved leading mail item and a subsequent mail item that overlaps the former.

Referring then to FIGS. 6 to 9, a more detailed description will be given of the operation of the above-described curving means and handling means. FIG. 6 is a schematic sectional view of the suction mechanism 13 obtained when viewed from upstream with respect to the pickup direction of mail items. FIG. 7 is a schematic sectional view illustrating a state in which a leading mail item is drawn to form a gap between the same and a subsequent mail item P. FIG. 8 is a schematic perspective view illustrating a state in which only the leading one of the accumulated mail items P is curved. FIG. 9 is a schematic perspective view useful in explaining the positional relationship between the curved leading mail item P and a subsequent mail item P that overlaps the former.

When a flow of air is generated by operating blower 41 of the suction mechanism 13 as shown in FIG. 6 after a plurality of mail items P are received in the feeding device 1, a leading mail item P1 closest to the pickup position 20 is drawn toward the surface 52 of the guide plate 51 as shown in FIG. 7.

At this time, the leading mail item P1 is curved by the two projections 54 and 55 (as shown in FIG. 7) so that the center of the item is protruded toward the guide plate 51. As a result, a vertically elongated space S (gap) is formed between the leading mail item P2 and a subsequent mail items P2.

As shown in FIGS. 8 and 9, air is introduced into the space S by the handling nozzle 17 from the upstream side of the rear end of the leading mail item P1. When the leading mail item P1 is curved to form a space, it can be separated from a subsequent mail item P. However, if air is introduced into the space S as in the first embodiment of the invention, the two mail items P1 and P2 can be more reliably separated from each other.

As described above, in the first embodiment, when a relatively small and thin mail item P, for example, a shortest mail item Pmin, is picked up by applying thereto negative pressure, the mail item Pmin is curved to form a gap into which air is fed. This being so, the rate of occurrence of simultaneous pickup of two or more mail items P, which may easily occur when such a thin and small mail item P is picked up, can be reduced.

It is desirable that flow of air be always produced by the handling nozzle 17 during the pickup operation of mail items P by the feeding device 1. Namely, even when a mail item P that is relatively long along the conveyance guide 28 is picked up, if flow of air is always produced, air can be fed into the space S during the time when the rear end of the mail item P passes the suction mechanism 13, whereby the relatively long mail items P can be separated from a subsequent mail item P.

However, a mail item P longer than a post card may well be a relatively heavy and hard sealed matter, and it is not strongly possible that this mail item P will be picked up simultaneously with a subsequent mail item P for the above-described reason. This means that the curving means and handling means of the first embodiment are most effectively used to handle relatively small and thin mail items P.

Further, in the first embodiment, a description has been given of the case of locating the nozzle 17 upstream of the pickup position 20 with respect to the mail pickup direction T, and introducing air into the space S formed between a curved mail item P and a subsequent one from behind the rear end of the curved mail item P, to handle the items. However, the invention is not limited to this. Air may be introduced into a space S' from the front as shown in FIG. 9. In any case, it is sufficient if a mail item P drawn to the pickup position 20 is curved to form the space S, and air is introduced into the space S.

Figure 10:
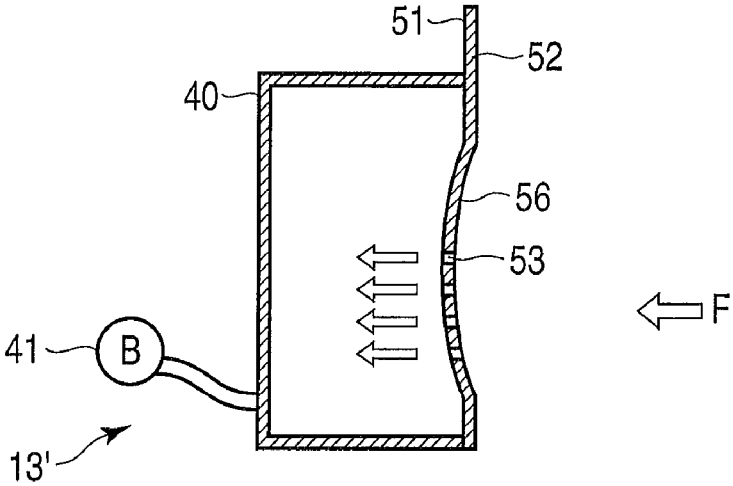
FIG. 10 is a schematic sectional view illustrating a modification of the suction mechanism shown in FIG. 6.

FIG. 10 shows a modification of the above-described first embodiment.

A suction mechanism 13' according to the modification includes, as curving means, a depressed portion 56 depressed in the guide plate 51 from the pickup position 20. The depressed portion 56 has a plurality of suction holes 53 formed therein, and serves to curve each mail item P drawn to the pickup position 20 using a flow of air (negative pressure), as in the first embodiment. As a result, also in the modification, a space S can be formed between a leading mail item P1 closest to the pickup position 20 and a subsequent mail item P2.

In the modification, the surface 52 of the guide plate 51 has no projection that projects toward the pickup position 20, therefore no adverse influence is exerted on the operation of picking up mail items P. In particular, since in this modification, the space S can be formed further away from the pickup position 20 than in the first embodiment, the distal end of the handling nozzle 17 (not shown in FIG. 10) does not project from the chamber 40 toward the pickup position 20.

Figure 11:
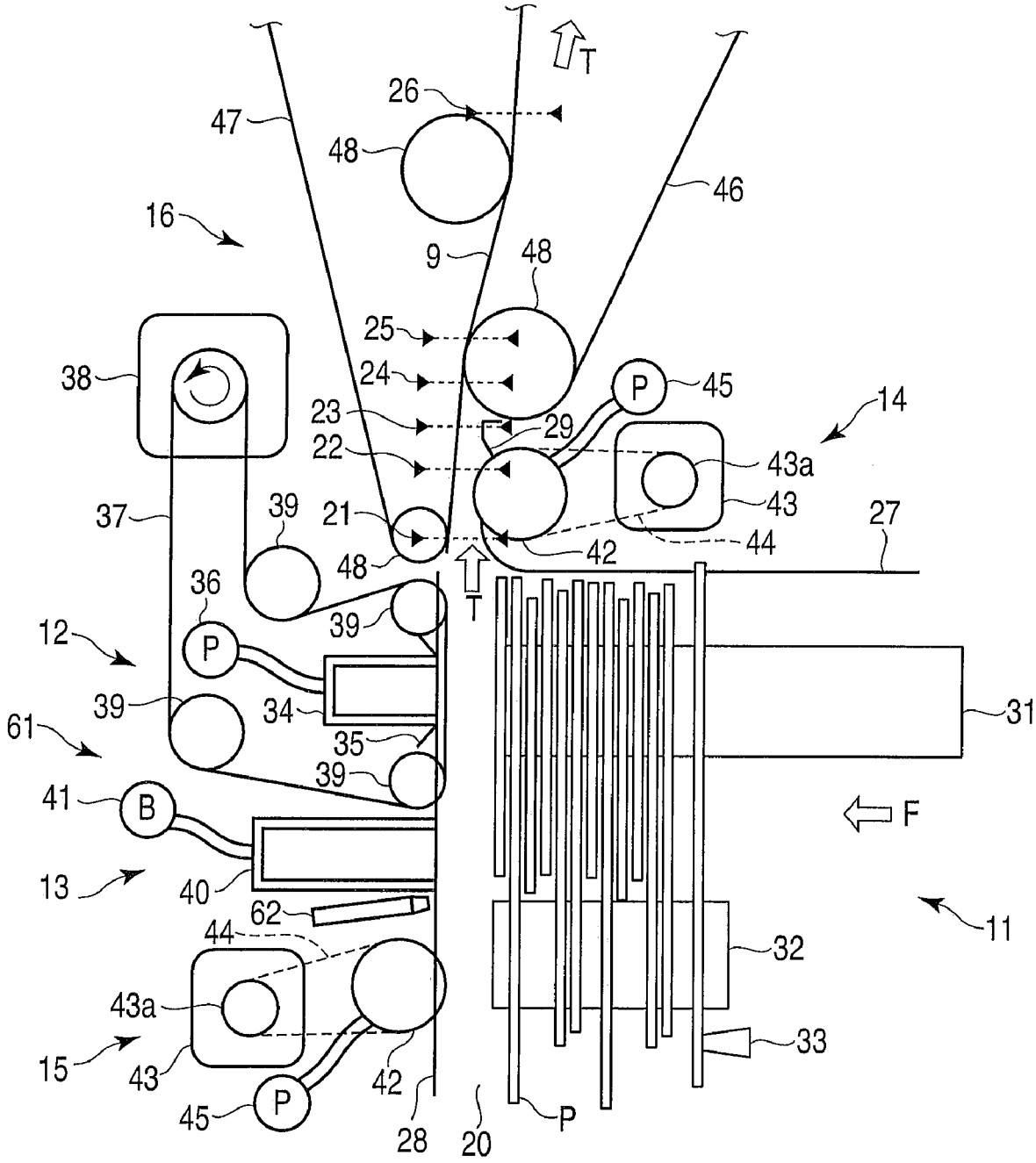
FIG. 11 is a schematic view illustrating a mail feeding device according to a second embodiment.

Referring to FIG. 11, a feeding device 61 according to a second embodiment will be described. The feeding device 61 has substantially the same structure as the feeding device 1 of the first embodiment, except that a handling nozzle 62 differs from the handling nozzle 17 in structure and attachment angle. Therefore, in the second embodiment, elements similar to those of the first embodiment are denoted by corresponding reference numbers, and no detailed description is given thereof.

The handling nozzle 62 is characterized in that it blows air to each mail item P, drawn to the pickup position 20 by the suction mechanism 13, at substantially right angles to the surface of each mail item P. Namely, the distal end of the handling nozzle 62 is not angled, which differs from the handling nozzle 17 of the first embodiment. When the handling nozzle 62 is employed, it is not necessary to protrude the distal end of the nozzle 62 to the pickup position 20, and there is no possibility of the distal end of the nozzle 62 catching a picked up mail item P. However, when this structure is employed, it is necessary to adjust the blowing pressure of the handling nozzle 62 applied to the surface of each mail item P, so as not to offset the negative pressure of the suction mechanism 13.

Further, it is desirable to tilt the handling nozzle 62 as shown in FIG. 11 so that it is positioned as parallel to the mail pickup direction T as possible. Namely, to feed air into the aforementioned space S between a leading mail item and a subsequent one, it is desirable to blow air from downstream with respect to the pickup direction T.

As described above, the second embodiment can provide the same advantage as the first embodiment. Namely, in the second embodiment, when air is blown through the handling nozzle 62 to mail items P, positioned in the pickup position 20, in a direction substantially perpendicular to the surface of the mail item P, it is applied to a mail item P subsequent to a leading mail item P after the rear end of the leading mail item passes. The air applied to the subsequent mail item P spreads over its surface. At this time, at least part of the spread air flows in the pickup direction T, whereby air flows into the space S between the leading and subsequent mail items P.

Further, the attachment position of the handling nozzle 62 of the second embodiment can be slightly changed. Thus, the air blowing position of the handling nozzle 62 can be set relatively freely, which means that the degree of freedom in the attachment position of the handling nozzle 62 is enhanced.

Figure 12:
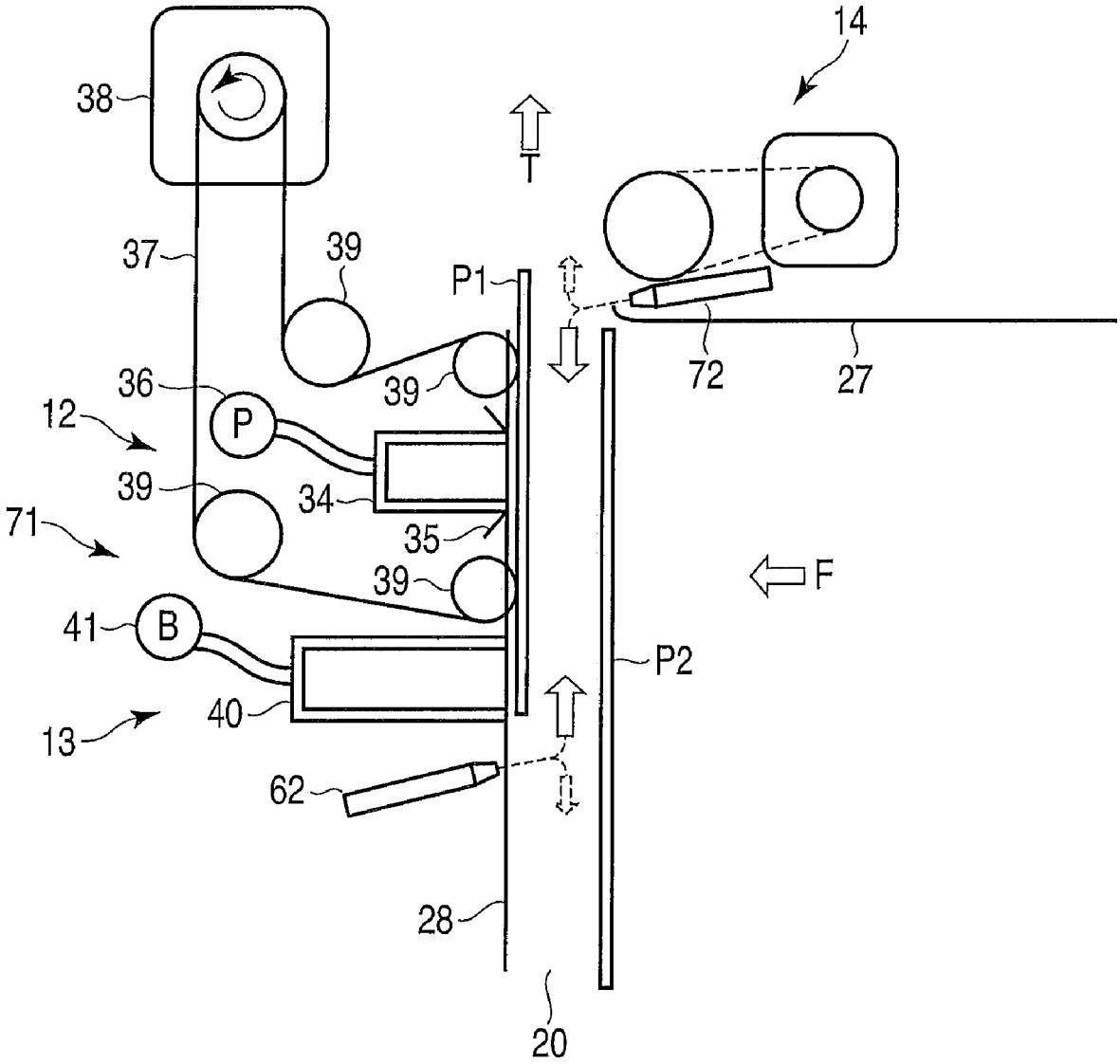
FIG. 12 is a schematic view illustrating the structure of the essential part of a mail feeding device according to a third embodiment.

FIG. 12 is an enlarged view illustrating the essential part of a feeding device 71 according to a third embodiment of the invention. The feeding device 71 has substantially the same structure as the feeding device 61 of the second embodiment except that another handling nozzle 72 is provided downstream of the pickup position 20. Therefore, in the third embodiment, elements similar to those of the second embodiment are denoted by corresponding reference numbers, and no detailed description is given thereof.

The handling nozzle 72 is located on the rear side of the conveyance guide 27 for aligning the pickup directional front ends of accumulated mail items P. In other words, the handling nozzle 72 is located near the front end of the pickup position with respect to the pickup direction T, i.e., near the upstream end of the conveyance path 9, in a position and attitude in which it can blow air to the surface of a leading mail item P close to a subsequent mail item P in a direction substantially perpendicular the surface.

When air is blown to a leading mail item P through the handling nozzle 72 located as above, it spreads over the surface of the leading mail item P, and at least part of the spread air flows in the direction (downward) indicated by the corresponding solid line in FIG. 12. As a result, air flows into the space S defined between leading and subsequent mail items P by curving the leading mail item P, and these mail items that are superposed on each other on the pickup directional front end side can be separated from each other.

As described above, the third embodiment can provide the same advantage as the second embodiment. Further, superposed mail items P can also be separated from each other downstream of the pickup position 20, whereby occurrence of simultaneous feeding of two or more mail items P can be avoided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For instance, although in the above-described second and third embodiments, the handling nozzles 62 and 72 are provided substantially perpendicular to the surface of each mail item P, the invention is not limited to this. The nozzles may be tilted toward the space S defined between mail items P. In this case, it is sufficient if the attachment angle of the pickup directional upstream-side handling nozzle 62 is set within a range of from an angle substantially perpendicular to the surface of each mail item P to an angle substantially parallel to the pickup direction T. Similarly, the attachment angle of the pickup directional downstream-side handling nozzle 72 is set within a range of from an angle substantially perpendicular to the surface of each mail item P to an angle substantially parallel to the direction opposite to the pickup direction T.

What is claimed is:

1. A paper sheet feeding device, comprising:

a supply mechanism configured to move a plurality of paper sheets simultaneously received upright and to feed a leading one of the paper sheets toward a pickup position;

a pickup mechanism configured to be brought into contact with the leading paper sheet fed toward the pickup position, and then to rotate to thereby pick up the leading paper sheet in a direction parallel to a surface of the leading paper sheet;

a suction mechanism configured to produce a flow of air upstream of a position, at which the pickup mechanism is brought into contact with the leading paper sheet, with respect to a direction in which the leading paper sheet is picked up, the flow of air being used to draw the leading paper sheet to the pickup position;

curving means configured to cooperate with the suction mechanism to curve the leading paper sheet drawn to the pickup position; and handling means configured to supply air into a gap formed between the leading paper sheet and a subsequent paper sheet superposed on the leading paper sheet, by curving the leading paper sheet using the curving means, thereby separating the leasing paper sheet from the subsequent paper sheet, wherein the suction mechanism includes a guide plate with a surface opposing the pickup position, a suction hole formed through the guide plate, and a blower which draws air from a reverse of the guide plate through the suction hole; and the curving means is formed of two projections projecting from an obverse of the guide plate toward the pickup position, the two projections being provided only in positions that are separated from each other in a direction perpendicular to the direction in which the leading paper sheet is picked up, the suction hole being interposed therebetween.

2. A paper sheet feeding device, comprising:

a supply mechanism configured to move a plurality of paper sheets simultaneously received upright and to feed a leading one of the paper sheets toward a pickup position;

a pickup mechanism configured to be brought into contact with the leading paper sheet fed toward the pickup position, and then to rotate to thereby pick up the leading paper sheet in a direction parallel to a surface of the leading paper sheet;

a suction mechanism configured to produce a flow of air upstream of a position, at which the pickup mechanism is brought into contact with the leading paper sheet, with respect to a direction in which the leading paper sheet is picked up, the flow of air being used to draw the leading paper sheet to the pickup position;

curving means configured to cooperate with the suction mechanism to curve the leading paper sheet drawn to the pickup position; and handling means configured to supply air into a gap formed between the leading paper sheet and a subsequent paper sheet superposed on the leading paper sheet, by curving the leading paper sheet using the curving means, thereby separating the leasing paper sheet from the subsequent paper sheet, wherein, the suction mechanism includes a guide plate with a surface opposing the pickup position, a suction hole formed through the guide plate, and a blower which draws air from a reverse of the guide plate through the suction hole; and the curving means includes a recess formed by curving the guide plate about an axis only parallel to the direction in which the leading paper sheet is picked up from the pickup position, the suction hole being formed in a bottom of the recess.

3. The paper sheet feeding device according to claim 1 wherein the suction hole is formed at a position at which a pickup-directional rear end of the leading paper sheet can be drawn, even when the leading paper sheet is shortest among the paper sheets in the direction in which the leading paper sheet is picked up.

4. The paper sheet feeding device according to claim 1 wherein the handling means includes a handling nozzle which blows air into the gap formed by the curving means between the leading paper sheet drawn to the pickup position, and the subsequent paper sheet superposed on the leading paper sheet, the handling nozzle blowing air from a side upstream of the pickup-directional rear end of the leading paper sheet.

5. The paper sheet feeding device according to claim 1 wherein the handling nozzle includes a slim discharge port formed along the gap formed by the curving means.

6. The paper sheet feeding device according to claim 1 wherein the handling nozzle is located at an angle falling within a range of from a first angle perpendicular to a surface of the leading paper sheet supplied to the pickup position, to a second angle substantially parallel to the surface of the leading paper sheet supplied to the pickup position, the handling nozzle being oriented downstream when located at the second angle.

7. A paper sheet feeding device comprising:

a supply mechanism configured to move a plurality of paper sheets simultaneously received upright and to feed a leading one of the paper sheets toward a pickup position;

a pickup mechanism configured to be brought into contact with the leading paper sheet fed toward the pickup position, and then to rotate to thereby pick up the leading paper sheet in a direction parallel to a surface of the leading paper sheet;

a suction mechanism configured to produce a flow of air upstream of a position, at which the pickup mechanism is brought into contact with the leading paper sheet, with respect to a direction in which the leading paper sheet is picked up, the flow of air being used to draw the leading paper sheet to the pickup position;

curving means configured to cooperate with the suction mechanism to curve the leading paper sheet drawn to the pickup position; and handling means configured to supply air into a gap formed between the leading paper sheet and a subsequent paper sheet superposed on the leading paper sheet, by curving the leading paper sheet using the curving means, thereby separating the leading paper sheet from the subsequent paper sheet, wherein the handling means includes a handling nozzle which, blows air from a downstream side with respect to a direction in which the leading paper sheet is picked up, said handling nozzle blowing air into the gap formed between the leading paper sheet and the subsequent paper sheet superposed on the leading paper sheet, by curving the leading paper sheet using the curving means.

8. The paper sheet feeding device according to claim 7, wherein said handling nozzle is located at an angle falling within a range of from a first angle perpendicular to a surface of the leading paper sheet supplied to the pickup position, to a second angle substantially parallel to the surface of the leading paper sheet supplied to the pickup position, the handling nozzle being oriented upstream when located at the second angle.

* * * * *